United States Patent [19]

Andrews, Sr.

[11] Patent Number: 4,948,122

[45] Date of Patent: Aug. 14, 1990

[54] ATHLETIC WEIGHT HARNESS

[76] Inventor: Darren L. Andrews, Sr., 2165 Malvern Ave., Dayton, Ohio 45406

[21] Appl. No.: 383,415

[22] Filed: Jul. 24, 1989

[51] Int. Cl.[5] ..... A63B 21/00

[52] U.S. Cl. ..... 272/119; 272/117

[58] Field of Search ..... 272/93, 94, 116, 117, 272/119, 122, 123, 143; 224/211

[56] References Cited

U.S. PATENT DOCUMENTS

| | | | |
|---|---|---|---|
| 2,990,089 | 6/1961 | Mystrom | 224/211 |
| 3,114,486 | 12/1963 | Flexman | 224/211 |
| 3,957,184 | 5/1976 | Shurman | 224/211 |
| 4,168,060 | 9/1979 | Hohlenfieldt | 272/94 |
| 4,339,124 | 7/1982 | Voglier | 272/94 |
| 4,394,012 | 7/1983 | Egbert et al. | 272/119 |
| 4,431,121 | 2/1984 | Biensette | 224/211 X |
| 4,676,502 | 6/1987 | Mahr | 272/119 |
| 4,714,247 | 12/1987 | Gersonnor | 272/119 X |

FOREIGN PATENT DOCUMENTS

| | | | |
|---|---|---|---|
| 3532512 | 3/1987 | Fed. Rep. of Germany | 272/119 |
| 2492264 | 4/1982 | France | 272/119 |
| 3736 | 1/1888 | United Kingdom | 272/119 |

*Primary Examiner*—Robert W. Bahr

*Attorney, Agent, or Firm*—Donald P. Gillette

[57] ABSTRACT

An athletic weight harness. The athletic weight harness includes a belt, a torso-protecting shield connected to the belt at the lower end of the torso-protecting shield, first and second adjustable straps connected to the upper end of the torso-protecting shield and the belt, and a weight post connected to the torso-protecting shield. The straps extending over the shoulders of the bodybuilder for retaining the athletic weight harness on the torso of the bodybuilder. The athletic weight harness holds exercise weight disks on a bodybuilder's chest or back at the level of the thorax. The shield prevents the bodybuilder from being struck by the weight disks, and the shoulder straps avoid irritating contact with the bodybuilder's neck during use.

11 Claims, 2 Drawing Sheets

ATHLETIC WEIGHT HARNESS

BACKGROUND OF THE INVENTION

This invention relates to a harness for supporting annular disk weights on the torso of a bodybuilder to exercise certain muscles while still leaving the bodybuilder's hands free. In particular, it relates to a harness for supporting the weights by means that protect the bodybuilder's torso from injurious contact with them.

Back pack assemblies have been used to allow swimmers and people responding to emergencies to carry tanks of oxygen while still leaving their hands free, as shown in U.S. Pat. Nos. 3,033,431 to Henderson et al.; 3,174,664 to Hue; 3,957,183 to Gadberry; and 4,327,851. In each case, the assemblies were made to hold cylindrical tanks, not the flat, annular disk weights used by athletes and bodybuilders to build strength and better musculature. Other devices to allow a person to carry or tow an object of some weight while still leaving that person's hands free are similar to the aforementioned tank-carrying devices and are shown in U.S. Pat. Nos. 3,114,486 to Flexman; 4,382,302 to Watson; and 4,431,121 to Bensette. The objects carried or towed are also fundamentally different from the annular disk weights.

U.S. Pat. No. 2,990,089 to Nystrom shows an arrangement of straps attached to a plate on which there is a U-shaped structure for holding binoculars in a convenient position on the chest of the user. Mahr shows a desire in U.S. Pat. No. 4,676,502 for supporting weights on a U-shaped torso base member suspended from straps that cross from one side of the base member to the other behind the wearer's back. A pin removably attached to the center of the base member supports the weights, which extend above the base member. U.S. Pat. No. 4,243,219 to Vogler shows a neck exercising helmet that has a plate attached across the top of it to support a post on which disk weights can be placed, and U.S. Pat. No. 4,714,247 to Gerstung shows a padded plate strapped to a gymnast's back and provided with a rod extending well past the gymnast's head to serve as a support for balancing weights that allow the gymnast's center of gravity to be approximately in line with the gymnast's extended arms.

OBJECTS AND SUMMARY OF THE INVENTION

It is one of the objects of this invention to provide an athletic weight harness that includes a shield on which to support disk weights at the level of the central region of a bodybuilder's thorax to hold the weights at the proper level for balance while shielding the bodybuilder from being struck by them.

Another object of the invention is to provide a weight harness that includes shoulder straps placed to avoid irritating contact with the neck of the bodybuilder wearing the harness.

Still another object of the invention is to provide a weight harness that includes a post rigidly attached to a shield component at an angle to it to help hold the weights in place.

A further object is to provide adjustable straps to secure the harness comfortably in place, either on the user's back or on his chest, according to the exercise to be performed.

Those skilled in the art will become aware of still further objects after reading the following description of the invention.

The weight support harness of this invention includes a shield large enough to cover a substantial part of either the back or front, but not both simultaneously, of the torso of a person. The shield is provided with a central post on which annular disk weights may be threaded, and the shield covers a larger area than the weights so as to prevent the weights from coming in contact with the person wearing the harness. A belt is attached to the lower level of the shield to encircle the wearer's waist to hold the lower part of the shield in place. In addition, the upper part of the shield has shoulder straps attached to it that extend directly over the wearer's shoulders without pressing against the sides of the wearer's neck and join lower straps extending upwardly from the regions of the lower part of the shield on the same side of the median plane of the wearer's body as the respective shoulder straps so that the straps do not cross over each other. Therefore, the straps avoid pressing against the sides of the neck of the person during exercise movements.

The shield may be made of stiff material, such as heavy leather or the like, and it is preferably provided with a layer of soft material, like lamb's wool, on the surface that faces the body of the wearer. In addition, the shield comprises a rigid metal plate to which the post is joined. The post is large enough and strong enough to allow annular disk weights to be fitted on it and held in place by any suitable means. Retention of the disk weights is aided by attaching the post at an angle to the plate such that the post is tilted slightly upward when the plate is vertical.

DETAILED DESCRIPTION OF THE INVENTION

Figure 1:
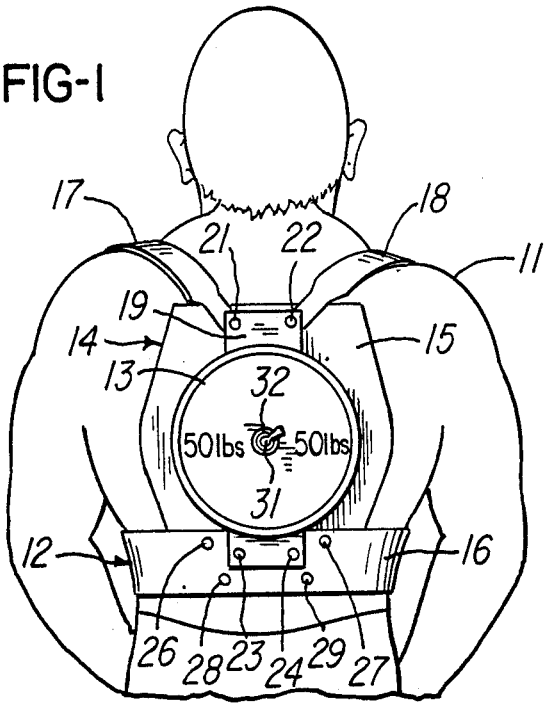
FIG. 1 shows the back of a bodybuilder wearing a harness in accordance with this invention.

FIG. 1 shows a bodybuilder 11 wearing a harness 12 on which a disk weight 13 is supported. The central part of the harness is a shield 14 held in position on the bodybuilder's thorax by a belt 16 that encircles his waist and a pair of shoulder straps 17 and 18 that extend over his left and right shoulders, respectively, away from abrasive contact with the neck of the bodybuilder. The belt is made of the same, relatively stiff leather used in belts worn just as belts by bodybuilders, but the straps 17 and 18 are of much softer material, such as a woven or knitted nylon tube, since the straps carry most of the weight and press down on the wearer's shoulders. The shield is worn so that its vertical center line is substantially coincident with the median plane of the thorax of the person wearing it.

The main part 15 of the shield is preferably formed of leather or the like so thick as to be almost rigid, and it may be curved to some extent to fit the back of the thorax of a bodybuilder, although it is not necessary that it fit precisely. While not shown in this figure, it is preferable that the inner surface of the shield 14 in contact with the bodybuilder's back be covered with soft material, such as lamb's wool, or the like.

The shield also comprises a rigid, rectangular, flat metal plate 19, the upper corners of which are attached to the outer surface of the main part 15 by rivets 21 and 22 that also attach one end of the straps 17 and 18, respectively, to the shield. The lower corners of the metal plate are attached to the main part of the shield by two more rivets 23 and 24 that also pass through the belt 16 and help hold it firmly joined to the shield. The lower portion of the main part 15 of the shield is further joined to the belt 16 by four more rivets 26–29.

Disk weights, like the weight 13, are made in a variety of sizes, from about 2 lbs. to 50 lbs. and are usually held on round bars by means of clamps. The diameter of standard weightlifting bars used for this purpose is about one inch, but Olympic bars are about twice as large. The weight 13 is supported by a post 31 that is preferably made of the same material used to make weightlifting bars. One end of the post is rigidly joined to the plate 19, for example by being welded to it, and the weights are held in place on the post by a standard clamp 32 of the type used on weightlifting bars.

Figure 2:
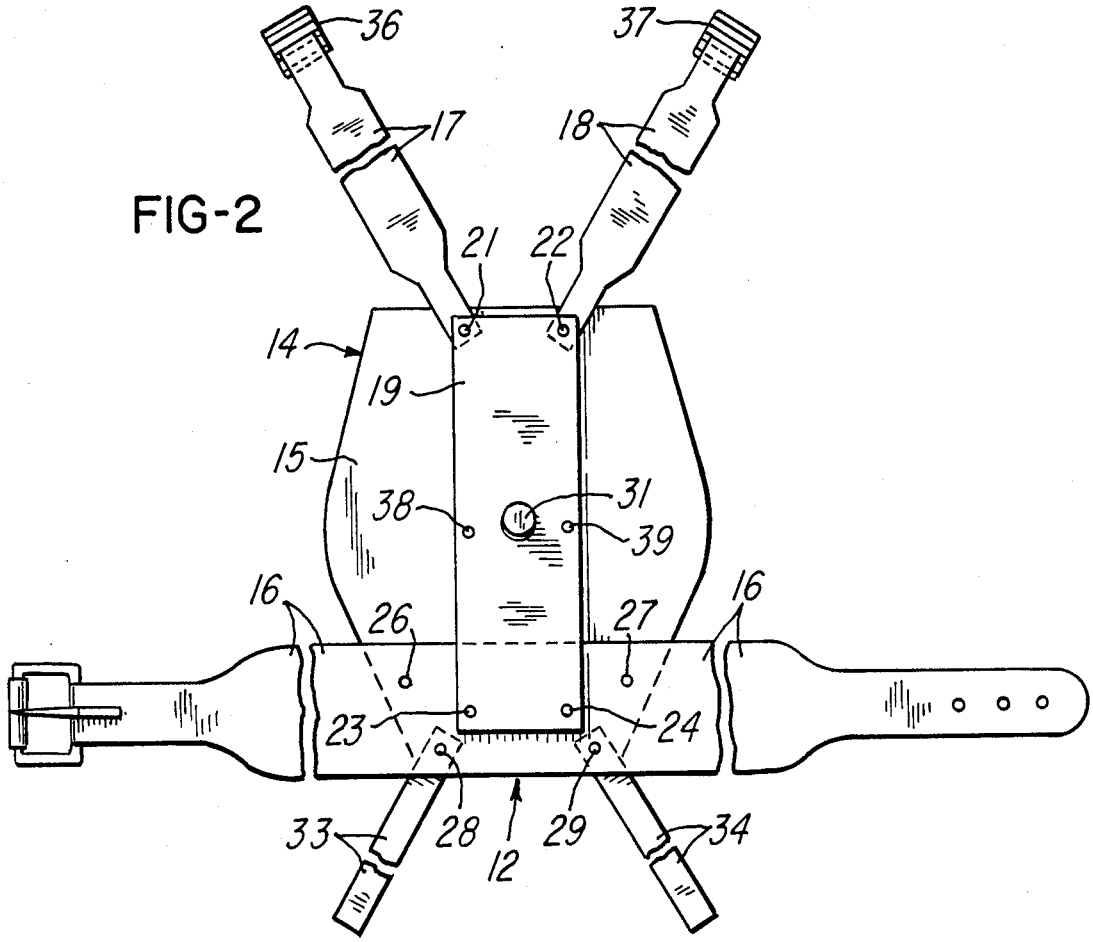
FIG. 2 is a plan view of the harness in FIG. 1.
Figure 3:
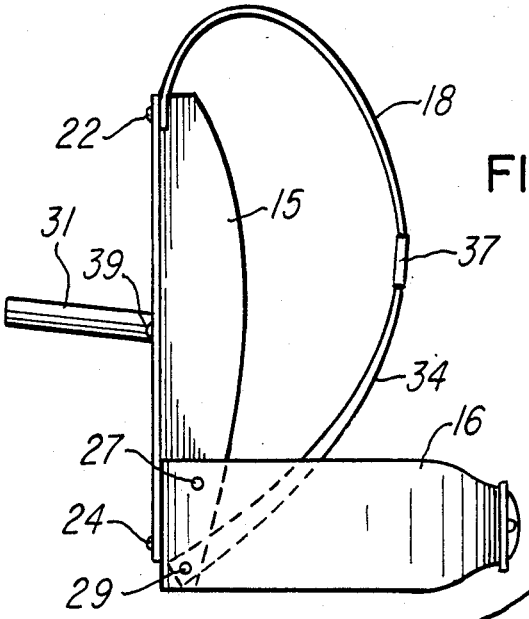
FIG. 3 is a side view of the harness in FIG. 2.

FIGS. 2 and 3 show parts of the harness 12 that are not visible in FIG. 1. One such part is a buckle 35 on the belt 16. In addition, there are also the lower parts 33 and 34 of the straps 17 and 18, respectively, and the buckles 36 and 37 on the straps 17 and 18 to join them to their respective lower parts. The latter are firmly joined to the belt 16 and the lower part of the shield 14 by the rivets 28 and 29, which are essentially below and a little farther from the vertical center of the shield than the rivets 21 and 22. As a result, neither the straps 17 and 18 nor their lower parts 33 and 34 cross over each other on either side of the torso of the bodybuilder wearing the harness.

It will be observed that the vertical dimension of the plate 19 is a little less than the vertical dimension of the main part 15 of the shield 14. Thus, the wearer is entirely protected from contact with any edges of the metal plate 19. In addition to the corner rivets 21–24 that affix the metal plate to the main part of the shield, there are two rivets 38 and 39 adjacent the post 31 in the central part of the plate 19 to hold that part of the plate firmly against the main part 15 of the shield 14. This places the post about midway between the waist and the shoulders of the person wearing the harness 12, which is the best place to help the wearer maintain balance during the performance of exercises. It is important for the weights to be held firmly so as not to jiggle from side to side as the bodybuilder goes through his exercises. Therefore, the plate 19 must be wide enough not to twist on the main part 15 of the shield. Making the plate at least about one-fourth to one-half as wide as it is high, and preferably about one-third as wide as it is high, provides ample spacing between the rivets 21 and 22 at the top of the plate and between the rivets 23 and 24 at the bottom. The width of the main part 15 of the shield 14 at the level of the post 31 needs to be at least substantially as great as the diameter of the largest disk weights, which are about 12″ to 18″ in diameter. The distance between the opposite side edges of the main part at its widest is preferably between two and three times the width of the plate 19.

The post 31 preferably does not extend perpendicularly from the plate 19 but, as is best shown in FIG. 3, at an angle slightly different from 90°. A suitable angle has been found to be 80° to 85° with respect to the upper part of the plate 19. This tilting of the post is helpful in keeping the weights from sliding off, especially while they are being put on and while the clamp 32 is being put on, but the clamp is sufficient to keep the weights in place after that.

Figure 4:
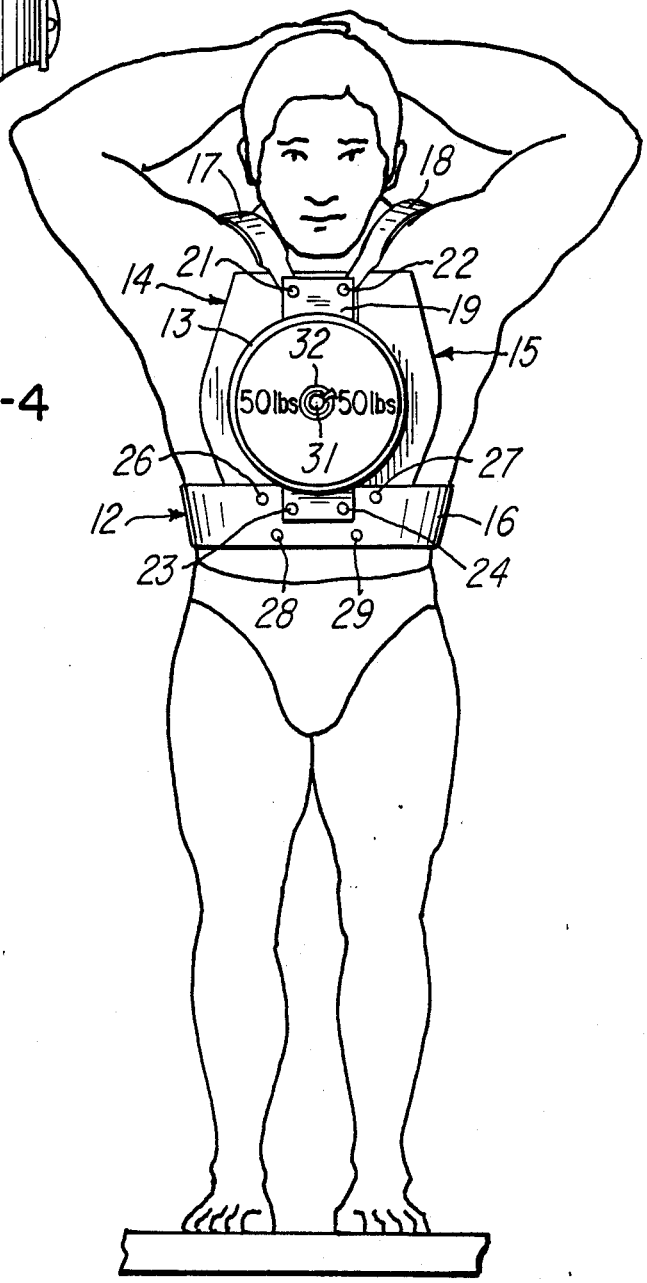
FIG. 4 shows the harness of FIG. 2 reversed to support the weight on the wearer's chest.

Many exercises that may be performed by a bodybuilder wearing the harness 12 can be performed best while the shield 14 and the weight, or weights, held on it are positioned on his back. These exercises include such things as jogging, in which the additional weight on the harness further strengthens the leg muscles, and lifting exercises, in which the additional weight moves the bodybuilder's center of gravity toward the back and allows him to concentrate more effort on lifting weights in front of him. However, exercises performed by the bodybuilder while lying on this back cannot be done while the shield and the post 31 are there. The arrangement of the belt 16 and the straps 17 and 18 permits the shield to be reversed so that it is over the bodybuilder's chest, i.e., the front part of the thorax, as shown in FIG. 4. While this may require the assistance of another person to adjust the buckles, the shield, itself, is as comfortably worn on the front as on the back. The post 31, which is at the center of gravity of the weight 13, is approximately midway between the bodybuilder's waist and his neck, which is ideal for maintaining proper balance, and whether the shield is on the bodybuilder's back or chest, the vertical center line of the shield is substantially coincident with the median plane of the bodybuilder's thorax.

What is claimed is:

1. An athletic weight harness to be worn on the torso of a bodybuilder, the harness comprising:

(a) a belt;

(b) a torso-protecting shield, the lower part of which is firmly secured to the belt and the upper part of which extends upwardly therefrom, whereby the shield covers a central part of one surface of the thorax of a user and extends horizontally on both sides of the median plane of the thorax, the shield comprising a main member and a rigid plate joined to the main member and extending substantially the entire vertical dimension of the central portion of the shield;

(c) first and second side straps having upper ends attached to the upper part of the shield at first and second locations, respectively, laterally spaced from the median plane of the bodybuilder to fit over the shoulders of the bodybuilder, the shoulder straps having ends attached to the belt at third and fourth locations, respectively, laterally spaced from the median plane of the bodybuilder, the effective lengths of the shoulder straps being adjustable to allow the harness to fit bodybuilders having thoraxes of different sizes; and (d) a weight-supporting post rigidly attached to the plate along a line substantially midway between the sides of the shield, the post being located, vertically, in the central region of the shield and projecting outwardly therefrom, the diameter of the post being small enough to accommodate the central opening of a standard, annular disk and large enough to provide controlled support of the disk weight.

2. The harness of claim 1 in which the rigid plate is metal and the main member is stiff non-metallic material.

3. The harness of claim 1 in which the post is joined to the rigid plate at an angle of between about 80° and 85° relative to the portion of the rigid plate directly above the point at which the post extends from the plate.

4. The harness of claim 1 in which the maximum vertical dimension of the shield is at least three times as great as the width of the portion of the belt to which the lower part of the shield is attached.

5. The harness of claim 1 in which parts of the side edges of the shield are rounded and the maximum horizontal dimension of the shield is at least 12" and is located at a vertical location substantially even with the location at which the post is attached to the rigid plate.

6. The harness of claim 5 in which the maximum horizontal dimension of the shield is at least as great as the diameter of the largest weight to be used thereon.

7. The harness of claim 1 in which the first and third locations are on one side of the median plane and the second and fourth locations are on the other side of the median plane and spaced the same distances from the median plane as the first and third locations, respectively, and the first and second locations are far enough apart to keep both of the straps from applying pressure to the bodybuilder's neck.

8. The harness of claim 1 in which the maximum width of the plate is substantially less than the maximum width of the shield.

9. The harness of claim 8 in which the vertical dimension of the plate is between about two and four times as great as its horizontal dimension and is a little less than the maximum vertical dimension of the shield.

10. The harness of claim 9 in which the vertical dimension of the plate is about three times as great as its horizontal dimension.

11. An athletic harness to be worn on the thorax of a bodybuilder, the harness comprising;

(a) an adjustable leather belt encircling the lower part of the torso of the bodybuilder;

(b) a shield comprising a relatively rigid, thorax-protecting, leather main part that is wider at a region intermediate its upper and lower ends than it is at those ends, the lower part of the shield being firmly attached to the belt and the upper part of the shield extending upwardly from the belt a distance several times as great as the height of the portion of the belt to which the shield is attached, whereby the shield covers a central part of one surface of the thorax of a bodybuilder wearing the harness and extends horizontally on both sides of the median plane of the thorax, the maximum width of the shield being less than the maximum width of the thorax of the bodybuilder;

(c) first and second shoulder straps having upper ends attached to the upper part of the shield at first and second locations that are symmetrically spaced on the right and left sides, respectively, of the median plane to fit over the shoulders of the bodybuilder and having lower ends attached to the belt at third and fourth locations symmetrically spaced on the right and left sides of the median plane, respectively, whereby each of the shoulder straps remains on its own side of the median plane when placed on the bodybuilder, the shoulder straps being of adjustable lengths to allow the harness to fit bodybuilders having thoraxes of different sizes;

(d) a rigid, rectangular, metal plate firmly secured to the main part and extending substantially the entire vertical dimension of the central portion of the shield, the width of the plate being less than half the width of the widest part of the shield; and (e) a weight-supporting post welded to the plate at a location on the median plane and at a central portion, vertically, of the shield, the post projecting outwardly from the shield and the diameter of the post being small enough to accommodate the central opening of a standard disk weight and large enough to provide rigid support of the weight.

* * * * *